United States Patent [19]

Brumfield

[11] 4,219,187

[45] Aug. 26, 1980

[54] STAPLE REMOVER

[76] Inventor: Stanford O. Brumfield, 28437 Nieman Rd., New Boston, Mich. 48164

[21] Appl. No.: 11,084

[22] Filed: Feb. 12, 1979

[51] Int. Cl.[3] ..... B66F 15/00; B25C 11/00

[52] U.S. Cl. ..... 254/28

[58] Field of Search ..... 254/28, 131; 145/1 A

[56] References Cited

U.S. PATENT DOCUMENTS 2,563,227 8/1951 Emery ..... 254/28

3,987,827 10/1976 Mills ..... 145/1 A

*Primary Examiner*—Robert C. Watson

*Attorney, Agent, or Firm*—Harness, Dickey & Pierce

[57] ABSTRACT

A device for removing large staples is disclosed. The staple remover has a blade at one end and a handle at the other connected by a lever arm to aid in the removal of the staples. The blade has a wedge-shaped portion adapted to slide under the staples and a pair of adjacent ears which firmly hold the staples in a fixed position during and after removal.

1 Claim, 2 Drawing Figures

STAPLE REMOVER

BACKGROUND—DESCRIPTION OF THE EMBODIMENT

Numerous devices are known today for removing staples of the size which are normally used on letters, correspondence, and other similar documents. Heretofore, however, there are not any devices on the market for quickly, safely, and effectively removing the large staples which are used mainly in industrial applications, such as for securing cardboard boxes together. These large staples are in the order of 1" to 1½" long and made of a relatively stiff gauge of metal. They are normally installed by a machine and are very difficult to remove by hand. For hand removal, most persons use a pair of plyers or a screwdriver to attempt to remove the staples. These methods are not only laborious, time consuming and frustrating, but also can be dangerous to the user as the ends of the staples are sharp and could seriously cut the person attempting to remove them. Further, when the staples are removed from the box, carton or similar structure with plyers or a screwdriver, the material is more often than not torn or ruined, thus making the box or carton unsuitable for reuse.

An object of the present invention is to provide an improved device for removing large staples which is simple to manufacture and use, removes the staples quickly and all at one time, provides no safety hazard for the user, and also leaves the box or carton in a reuseable condition. Other objects, features, and advantages of the invention will become apparent when the following description and claims are viewed in accordance with the attached drawings.

In accordance with the present invention, the staple remover contains a blade section that has a wedge-shaped member adapted to be inserted under the staple. A pair of ears, one positioned on either side of the wedge-shaped member and adjacent thereto, are also provided. The ears are adapted to be pushed firmly into position on top of the staple at its outer ends on either side of the portion under which the blade is positioned. The ears firmly hold the staple in place, both during removal and afterwards. The staple is not allowed to fly loose after removal where it could be dangerous to the person removing it; also, the staple can be easily discarded in a proper manner. A lever-arm is connected to the blade section and provides a mechanical advantage for removal of the staples. A handle is also connected to the lever-arm in order to allow the remover to be used more easily.

DESCRIPTION OF THE PREFERRED EMBODIMENTS

Figure 1:
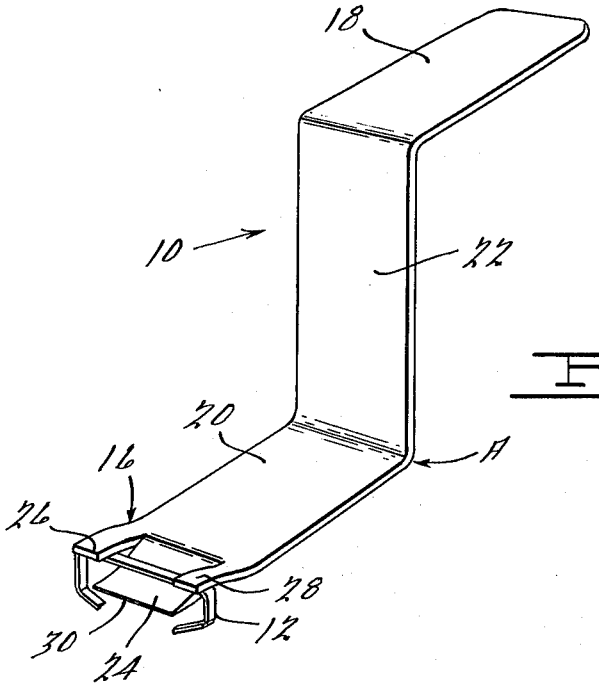
FIG. 1 illustrates the inventive staple remover.

As shown in the drawings, the present invention comprises a staple remover 10 which is used to remove large staples from boxes, cartons and the like which are typically used in industry today. The term "large staples" is used to distinguish them from the smaller staples which are used to staple correspondence and other documents together in normal office use. The large staples are typically on the order of 1" to 1½" in length and made from a relatively heavy gauged metal. They are virtually impossible to remove by hand and also have sharp ends creating a safety hazard for the person removing them. The large staples are typically used to hold cardboard and thin wood cartons and boxes together so that they will not come apart during shipping, transport and handling.

Figure 2:
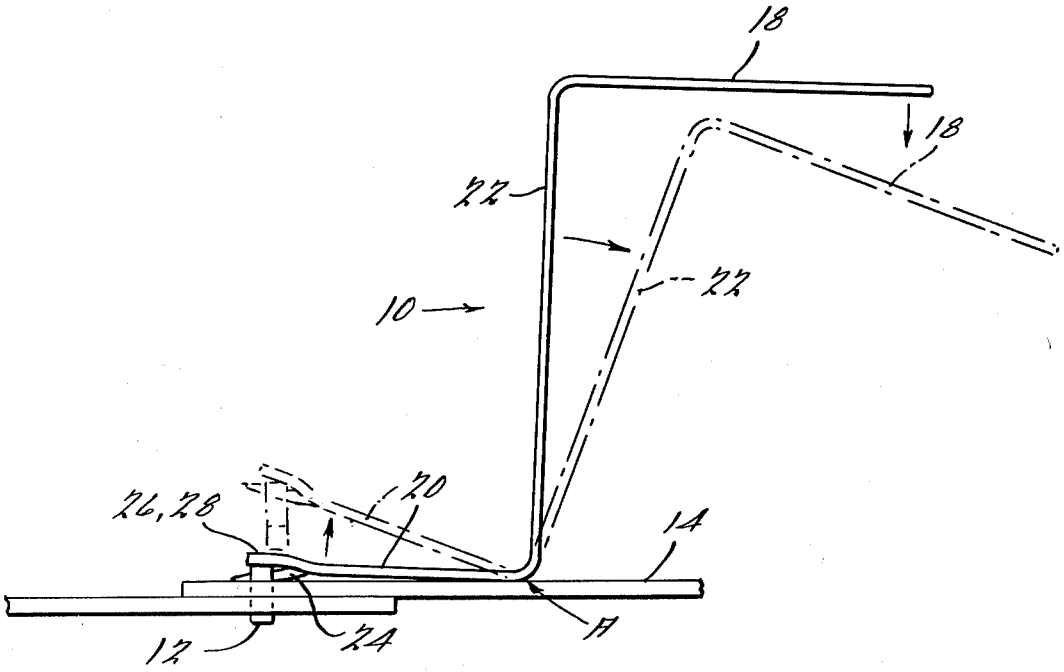
FIG. 2 illustrates the manner in which the staple remover is used.

The large staples are indicated by the numeral 12 in the drawings. A conventional box or carton is depicted in FIG. 2 by the numeral 14 and shows the manner in which two sections thereof are typically fastened together by the staple 12.

The staple remover 10 comprises a blade section 16 at one end and a handle 18 at the opposite end. In between these two sections is a lever-arm portion 20 and an intermediate portion 22 which connects the lever-arm 20 and the handle 18. The portion 20 is called a "lever-arm" because when the staple remover 10 is used, the remover 10 pivots around point A providing a mechanical advantage for the user to remove the staples. The movement of the staple remover 10 during use is shown in phantom lines in FIG. 2 and indicated by appropriate arrows.

The staple remover 10 is preferably made of metal, although it can be made of any other material which would have sufficient strength and rigidity to be used in the manner disclosed. Preferably, the remover 10 is cut and formed from a piece of sheet metal on the order of one-eighth of an inch in thickness. In the preferred embodiment of the invention, the staple remover 10 is cut from a single twelve inch long piece of metal; in this regard, the lever-arm portion which includes the blade section is approximately three inches long, the intermediate portion is approximately five inches long, and the handle portion is approximately four inches long. The staple remover 10 should be wide enough to substantially cover the whole upper surface of the staple which is visible on the surface of the carton 14. Preferably, the remover 10 is approximately one and three-eights of an inch in width. By providing the staple remover of substantially the same width as the staple, the staple is removed more easily and in one piece without significantly bending it.

The handle 18 is positioned a distance above the lever arm 20 in order to facilitate easier and better use of the remover 10. If desired, the handle 18 can be covered with any type of conventional material, such as wood, leather or the like, in order to provide a more comfortable tool for the user.

The blade section 16 of the staple remover 10 has a wedge-shaped blade member 24 and a pair of ears 26 and 28. As shown in FIG. 1, the blade 24 is centered between the ears. The blade 24 has a front edge 30 which is relatively thin so that it will slide easily beneath the staple 12 on the carton 14. The ears 26 and 28 are bent upwardly so that they extend above the upper surface of the lever-arm 20. The blade 24 and the ears 26 and 28 are formed in position such that the staple 12 can be slid up the wedge-shaped surface of the blade 24 into a wedging engagement between the blade and the lower surfaces of the ears. In this manner, when the staple remover 10 is pushed into position as shown in solid lines in FIG. 2, the staple 12 is held in a fixed position in the blade section 16. When the staple 12 is removed, as shown in phantom lines in FIG. 2, the staple will remain fixed in position in the staple remover 10. This prevents the staple from being tossed or flipped by the staple remover and possibly injuring the user, or other persons nearby. It also prevents the staple from being thrown into nearby machinery or ending up on the floor where it might be stepped on. Also, due to the forces exerted by the staple remover 10 along the entire exposed part of the staple 12, the staple is removed without being bent significantly and also without significantly tearing or damaging the box or carton 14. The carton 14 then can be reused if desired, and the staples also are subject to be reused without significant effort or expense.

While is will be apparent that the preferred embodiments illustrated herein are well calculated to fulfill all the objects stated above, it will be appreciated that the prevent invention is susceptable to modification, variation and change without departing from the scope of the invention, as defined by the following claims.

I claim:

1. A staple remover comprising: blade means, lever-arm means, said blade means positioned at one end of said lever-arm means, a handle, and an intermediate portion attached to the other end of said lever-arm means and connecting said handle to said lever-arm means, said lever arm means extending generally parallel to said handle and said intermediate portion extending at a right angle to each of said lever arm means and said handle, said blade means having a wedge-shaped member for removing said staples and a pair of ears, one of said pair of ears being positioned above and on each side of said wedge-shaped member, the upper surface of said wedge-shaped member and the lower surface of each of said ears being non-parallel and continuously converging for holding said staples in a fixed position during their removal and afterwards.

* * * * *